US008999005B2

(12) United States Patent
Loro Piana

(10) Patent No.: US 8,999,005 B2
(45) Date of Patent: Apr. 7, 2015

(54) PROCESS FOR OBTAINING AN AGED OR FADED EFFECT ON GARMENTS MADE OF CASHMERE

(75) Inventor: Pier Luigi Loro Piana, Quarona (IT)

(73) Assignee: Loro Piana S.p.A., Quarona (VC) (IT)

( * ) Notice: Subject to any disclaimer, the term of this patent is extended or adjusted under 35 U.S.C. 154(b) by 994 days.

(21) Appl. No.: 11/432,057

(22) Filed: May 11, 2006

(65) Prior Publication Data

US 2006/0253998 A1 Nov. 16, 2006

(30) Foreign Application Priority Data

May 11, 2005 (IT) ..... TO05A0321

(51) Int. Cl.

| | |
|---|---|
| ***D06M 11/00*** | (2006.01) |
| ***D06M 13/00*** | (2006.01) |
| ***D06M 15/00*** | (2006.01) |
| ***D06P 1/00*** | (2006.01) |
| ***D06B 11/00*** | (2006.01) |

(52) U.S. Cl.
CPC ..... *D06B 11/0096* (2013.01); *D06B 11/0089* (2013.01)

(58) Field of Classification Search
USPC ..... 8/115.51
See application file for complete search history.

(56) References Cited

U.S. PATENT DOCUMENTS

| | | | | |
|---|---|---|---|---|
| 4,816,033 | A | 3/1989 | Hoffer et al. | |
| 5,380,447 | A * | 1/1995 | Kirk et al. | 510/276 |
| 5,571,444 | A * | 11/1996 | Fisher et al. | 252/8.62 |
| 2003/0171249 | A1 | 9/2003 | Lang et al. | |

FOREIGN PATENT DOCUMENTS

| | | |
|---|---|---|
| FR | 2 808 815 | 11/2001 |
| GB | 1 505 497 | 3/1978 |
| WO | WO 98/45527 | 10/1998 |

* cited by examiner

*Primary Examiner* — Harold Pyon
*Assistant Examiner* — Katie L Hammer
(74) *Attorney, Agent, or Firm* — Merchant & Gould P.C.

(57) ABSTRACT

A process obtains an aged or faded effect on garments made of protein fibers such as wool, cashmere and silk. Granules of inert materials, which are particularly light in order not to damage very fine fibers, are introduced into a tumbler. The garments were previously treated with a chemical product commonly referred to as "dye retardant" for inhibiting dyeing of the fabric. The tumbler is pre-arranged so that the chemical product does not migrate through holes or openings. Raw confectioned garments that are to be treated, such as jerseys or outerwear, are introduced into the tumbler. The garments are extracted from the tumbler at the end of migration of the chemical product for inhibiting dyeing of the outer surface of the garments by the granules and steamed in an autoclave to fix the chemical process of the product for inhibiting dyeing of the outer surface of the garments. The garments are then dyed with a specific selection of dyes that must be defined each time according to the desired result.

1 Claim, No Drawings

PROCESS FOR OBTAINING AN AGED OR FADED EFFECT ON GARMENTS MADE OF CASHMERE

BACKGROUND OF INVENTION

The subject of the present invention is a process for obtaining an aged or faded effect on garments made of protein fibres, such as wool, cashmere and silk, and the product that can be obtained using said process.

SUMMARY OF INVENTION

The main purpose of the invention is to reproduce the aged or faded effect, known for many years now as "stone-washed effect" and widely applied on garments made of cotton, on protein fibres such as wool, cashmere and silk, maintaining and preserving the unique qualities of these fibres and at the same rendering them similar to garments made of cotton but only as regards appearance.

Unlike cellulose fibres, protein fibres (hereinafter, for reasons of convenience, the former will be referred to as "cotton fibres", and the latter as "cashmere fibres") present a high affinity to dyeing materials normally used, so that it is much more difficult, if not impossible, to obtain a dyeing suitable for reproducing the classic effect of ageing or fading without running up against major drawbacks due to the use of aggressive chemical products and/or abrasive physical media, which irreparably deteriorate the fibre, bestowing thereupon a "rough feel" even after strong softening agents have been used.

In fact, in order to obtain an appreciable aged or faded effect on cashmere, it is necessary to dye this fibre in such a way as to create weak bonds between the fibre and the dye, at the expense of the subsequent resistance to use. This consequence is certainly deleterious, given the intrinsic nobility of cashmere fibre, of the products obtained therewith, and of the consequent expectations of the clientele that characterizes them.

Given the smaller difference of intensity, artificially aged or faded cashmere garments thus obtained and up to now available on the market, are absolutely not comparable to stone-washed cotton garments.

In order to overcome the drawbacks cited above, the invention proposes inhibition of dyeing rather than dyeing and subsequent discolouring.

This step of inhibition, however, must be performed in such a way that the result will have a "denim" effect, i.e., one presenting lighter intensities of colour in the outermost areas and darker intensities in the parts less in relief (in seams of the confectioned garment, in the ribs of the stitches, in the hollows of the weave, in the stitches of quilted seams, in the most beaten wales of the collars or lapels of jackets).

The outstanding features of the process according to the invention are the following: not removing the colour from the dyed garment but, using an agent for inhibiting dyeing, which is known in the sector as "dye retardant", preventing the colour from binding to the fibre and dyeing it. According to the invention, granules of an inert material are imbibed with this dye retardant and are introduced together with a raw garment into a tumbler, where the stone-washed pattern on cotton is copied (in negative), as occurs with pumice stones that freely roll together with the garments to be treated.

In this way, a harmonious, irregular, pattern is obtained with marked difference in intensity, which resembles very closely an aged garment, faded in the parts that are more exposed to wear, the garment obtained being never the same as another garment and consequently unique.

BRIEF DESCRIPTION OF PREFERRED EMBODIMENTS

The process, as has been seen, is essentially based upon the pre-dyeing treatment that represents the real point of differentiation with respect to all the processes currently adopted.

This treatment must be applied on raw confectioned garments, whether jerseys or outerwear, which are "tailor-made" according to the requirements of the customer. No particular restrictions or solutions exist in this regard.

The garments are treated in a tumbler (of the type similar to that of a washing machine) pre-arranged in such a way as not to cause migration of the material used as carrier for the treatment product through holes or openings.

Normally, the treatment products are carried or supported by water. In this case, instead, inert materials are used, which have specific characteristics for surface deposition of the chemical component and are particularly light in order not to damage the very fine fibres of the materials of which the garments are made.

Among suitable inert materials are vermiculite, polystyrene, and many other materials suitable for being imbibed with the chemical product for inhibiting dyeing of the fabric and for releasing said product easily; in addition, the composition of said materials is such as not to abrade the fabric with which they come into contact.

The basic inhibiting chemical product falls into the category commonly referred to in the sector as "dye retardants".

One of such products is sold under the trade name SANDOSPACE® and is an anionic derivative of triazine.

The process according to the invention is described in what follows.

The raw confectioned garments, whether jerseys or outerwear, that are to undergo the treatment according to the invention are introduced into a tumbler. Also introduced into the tumbler are granules of inert materials, which are particularly light in order not to damage the very fine fibres of the materials of which the garments are made and which are previously imbibed with a chemical product for inhibiting dyeing of the fabric, of the type commonly referred to as "dye retardant".

Added to this product are an imbibing product and a chemical additive for rendering the environment in which the treatment occurs slightly acidic.

The ratios of the bath (amount of treatment material over weight of the garments to be treated) depend a lot upon the result that is to be obtained. Preferably, but not necessarily, a range of between 5 and 25 liters of bath (inert product and chemical components) for every kilogram of garments to be is treated has been identified.

The treatment time ranges from 15 to 45 minutes, during which the product for inhibiting dyeing migrates from the granules of inert material to the outer surface of the garment to be treated.

The treatment is to be completed with steaming of the garment in autoclave in order to fix the chemical process, i.e., the product for inhibiting dyeing on the outer surface of the garment.

The steaming times range from 10 to 60 minutes at a temperature of between 60° C. and 100° C.

Subsequent dyeing of the garment occurs with a specific selection of dyes that must each time be defined according to the desired result. Dyeing must occur according to the normal procedures of dyeing of a garment and will be able to achieve that particular aged or faded effect, without spoiling the characteristics of softness and comfort of the garments treated.

Of course, since the garment has been treated by the product for inhibiting dyeing only on the outer surface, inside it will be dyed perfectly as if the fading treatment had not been carried out.

The invention claimed is:

1. A process for obtaining an aged or faded effect on garments made of cashmere fibers comprising the following steps:

introducing undyed confectioned garments and a dye retardant chemical product for inhibiting dyeing of fabric of the undyed garments into a tumbler, the tumbler being pre-arranged to prevent migration of the chemical product through holes or openings;

introducing a plurality of granules of inert materials into the tumbler, wherein the granules are light in order not to damage the cashmere fibers of which the garments are made, the granules being previously imbibed with a chemical product for inhibiting dyeing of the fabric;

extracting the undyed garments from the tumbler at the end of migration of the chemical product for inhibiting dyeing from the granules to the outer surface of the undyed garments;

steaming in an autoclave for fixing the chemical product for inhibiting dyeing on the outer surface of the undyed garments; and subsequent dyeing of the garments with a specific selection of dyes that is defined according to a desired result.

* * * * *